US010995757B2

(12) United States Patent
Gruene et al.

(10) Patent No.: US 10,995,757 B2
(45) Date of Patent: May 4, 2021

(54) DRY-RUNNING GAS VANE PUMP HAVING A FIRST FLUID OUTLET AND A SECOND FLUID OUTLET ASSOCIATED WITH THE PUMP CHAMBER WITH THE SECOND FLUID OUTLET PERMANENTLY OPEN TO ATMOSPHERE WITHOUT BEING IMPEDED

(71) Applicant: PIERBURG PUMP TECHNOLOGY GMBH, Neuss (DE)

(72) Inventors: Tobias Gruene, Arnsberg (DE); Nabil Salim Al-Hasan, Korschenbroich (DE); Steffen Schnurr, Essen (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 219 days.

(21) Appl. No.: 16/310,817

(22) PCT Filed: Feb. 1, 2017

(86) PCT No.: PCT/EP2017/052166
§ 371 (c)(1),
(2) Date: Dec. 18, 2018

(87) PCT Pub. No.: WO2017/220212
PCT Pub. Date: Dec. 28, 2017

(65) Prior Publication Data

US 2020/0309134 A1 Oct. 1, 2020

(30) Foreign Application Priority Data

Jun. 22, 2016 (WO) ..... PCT/EP2016/064429

(51) Int. Cl.
*F04C 29/12* (2006.01)
*F04C 18/344* (2006.01)
(Continued)

(52) U.S. Cl.
CPC ..... *F04C 29/128* (2013.01); *F04C 18/344* (2013.01); *F04C 25/02* (2013.01);
(Continued)

(58) Field of Classification Search
CPC ..... F04C 29/126; F04C 18/344; F04C 25/02
(Continued)

(56) References Cited

U.S. PATENT DOCUMENTS 3,016,184 A * 1/1962 Hart ..... F04C 18/344 418/76
3,267,862 A * 8/1966 Mosbacher ..... F04C 13/007 418/15

(Continued)

FOREIGN PATENT DOCUMENTS

CN 201786661 U 4/2011
CN 204402889 U 6/2015

(Continued)

*Primary Examiner* — Patrick Hamo
*Assistant Examiner* — Benjamin Doyle
(74) *Attorney, Agent, or Firm* — Norman B. Thot

(57) ABSTRACT

A dry-running vane gas pump includes a pump housing which forms a pump chamber, a pump rotor with at least one displaceable slide element which pump rotor is rotatably supported in the pump chamber, at least one fluid inlet opening associated with the pump chamber, a first fluid outlet opening associated with the pump chamber, a second fluid outlet opening associated with the pump chamber, and a non-return valve which closes the first fluid outlet opening. The second fluid outlet opening is permanently open. The first fluid outlet opening is arranged before the second fluid outlet opening in a direction of rotation of the pump rotor.

7 Claims, 2 Drawing Sheets

(51) Int. Cl.
*F04C 25/02* (2006.01)
*F04C 29/06* (2006.01)

(52) U.S. Cl.
CPC ..... *F04C 29/065* (2013.01); *F04C 29/126* (2013.01); *F04C 2220/12* (2013.01); *F04C 2250/20* (2013.01)

(58) Field of Classification Search
USPC ..... 417/443; 418/189, 268
See application file for complete search history.

(56) References Cited

U.S. PATENT DOCUMENTS 3,320,899 A * 5/1967 Doleschalek ..... F04C 15/0049 418/74
3,459,275 A 8/1969 Prillwitz et al.
3,707,339 A * 12/1972 Budgen ..... F04C 28/28 418/13
3,790,314 A * 2/1974 Swain ..... F04C 2/3446 418/1
4,204,816 A * 5/1980 Bein ..... F04C 2/025 418/15
4,737,088 A * 4/1988 Taniguchi ..... F04C 29/0035 418/100
4,746,280 A * 5/1988 Wystemp ..... F01C 21/0809 418/152
5,100,308 A * 3/1992 Gevelhoff ..... F01C 21/102 418/152
5,310,326 A * 5/1994 Gui ..... F01C 21/10 418/150
5,378,111 A * 1/1995 Christopher ..... F02M 37/045 417/203
5,536,153 A * 7/1996 Edwards ..... F01C 21/0809 418/97
5,716,201 A * 2/1998 Peck ..... F01C 21/0863 417/284
6,739,850 B2 * 5/2004 Kawasaki ..... F04C 2/088 418/166
6,872,065 B1 * 3/2005 Shimada ..... F04C 29/061 418/259
8,608,465 B2 * 12/2013 Sexton ..... F04C 15/06 418/15
10,767,649 B2 * 9/2020 Moon ..... F04C 18/344
2002/0054822 A1 * 5/2002 Watanabe ..... F04C 2/086 418/171
2014/0286807 A1 * 9/2014 Sekiya ..... F04C 29/128 418/55.1
2014/0369878 A1 * 12/2014 Shimaguchi ..... F04C 18/3442 418/15
2015/0147216 A1 * 5/2015 Shimaguchi ..... F01C 21/106 418/236
2016/0017885 A1 1/2016 Al-Hasan et al.
2019/0345943 A1 * 11/2019 Schnurr ..... F04C 18/344

FOREIGN PATENT DOCUMENTS

CN 105065281 A 11/2015
DE 10 2010 029 551 A1 12/2011
DE 10 2013 104 375 A1 10/2014
EP 2 568 180 A1 3/2013
EP 2 853 748 A1 4/2015
JP 56-41187 4/1981
JP S62-93496 A 4/1987
JP 2012-87701 A 5/2012
JP 2013-249768 A 12/2013
JP 2016-44606 A 4/2016
JP 2016-48057 A 4/2016
WO WO 2013/105386 A1 7/2013
WO WO 2014/135202 A1 9/2014

* cited by examiner

DRY-RUNNING GAS VANE PUMP HAVING A FIRST FLUID OUTLET AND A SECOND FLUID OUTLET ASSOCIATED WITH THE PUMP CHAMBER WITH THE SECOND FLUID OUTLET PERMANENTLY OPEN TO ATMOSPHERE WITHOUT BEING IMPEDED

CROSS REFERENCE TO PRIOR APPLICATIONS

This application is a U.S. National Phase application under 35 U.S.C. § 371 of International Application No. PCT/EP2017/052166, filed on Feb. 1, 2017 and which claims benefit to International Patent Application No. PCT/EP2016/064429, filed on Jun. 22, 2016. The International Application was published in German on Dec. 28, 2017 as WO 2017/220212 A1 under PCT Article 21(2).

FIELD

The present invention relates to a dry-running vane gas pump.

BACKGROUND

Vane gas pumps have previously been described and are used in motor vehicles as so-called vacuum pumps, usually in combination with a brake force booster. The vane pump thereby provides the vacuum required to operate the brake force booster, wherein this vacuum normally has an absolute value of 100 mbar or less.

Previously-described vane gas pumps are normally dry-running or oil-lubricated vane gas pumps, wherein, in dry-running gas pumps, no lubricant is conducted into the pump chamber. In oil-lubricated vane gas pumps, the air exiting from the pump chamber has been mixed with lubricant, wherein, prior to disposal of this air-lubricant mixture, the air-lubricant mixture must be separated into its components by a complex process. Contamination of the air leaving the pump chamber can be avoided by omitting the lubricant. Omission of the lubricant will, however, cause an increased wear of the components moving relative to each other, particularly of the slide elements. Wear is usually reduced to a minimum by a well-aimed selection of suitable material pairings for the components abutting each other and moving relative to each other.

A dry-running vane gas pump of the above type is described in EP 2 568 180 A1. This vane gas pump comprises a pump housing defining a pump chamber. In the pump chamber, a pump rotor is arranged which comprises five radially displaceable slide elements. The pump rotor is connected to an electric motor for common rotation therewith and is driven by the an electric motor. In a rotating pump rotor, the slide elements will be displaced, under the effect of the centrifugal force acting on the slide elements, in a manner causing their respective head to be in abutment on a circumferential wall of the pump chamber, wherein two adjacent slide elements together with the pump rotor and the pump housing respectively delimit a pumping compartment. A fluid inlet opening and two fluid outlet openings are formed in the pump housing, wherein the fluid inlet opening and the outlet openings are associated to the pump chamber. Both fluid outlet openings comprise a respective non-return valve so that the fluid outlet openings will be cleared only when a predefined overpressure prevails in the pumping compartment.

A disadvantage of the arrangement described in EP 2 568 180 A1 is that during the discharge of air via the two fluid outlet openings both the non-return valve associated to the first fluid outlet opening and the non-return valve associated to the second fluid outlet opening will impede the outflow of the pressureless air so that a certain overpressure in the pumping compartment in the outlet sector will always prevail. This causes a mechanical stress on the slide elements, resulting in an increase of the mechanical wear of the slide elements, of the power consumption of the electric motor, and of the obtainable end pressure.

SUMMARY

An aspect of the present invention is to avoid the above mentioned disadvantages.

In an embodiment, the present invention provides a dry-running vane gas pump which includes a pump housing configured to form a pump chamber, a pump rotor comprising at least one displaceable slide element, the pump rotor being rotatably supported in the pump chamber, at least one fluid inlet opening associated with the pump chamber, a first fluid outlet opening associated with the pump chamber, a second fluid outlet opening associated with the pump chamber, and a non-return valve configured to close the first fluid outlet opening. The second fluid outlet opening is configured to be permanently open. The first fluid outlet opening is arranged before the second fluid outlet opening in a direction of rotation of the pump rotor.

BRIEF DESCRIPTION OF THE DRAWINGS

The present invention is described in greater detail below on the basis of embodiments and of the drawings in which.

DETAILED DESCRIPTION

Figure 1:
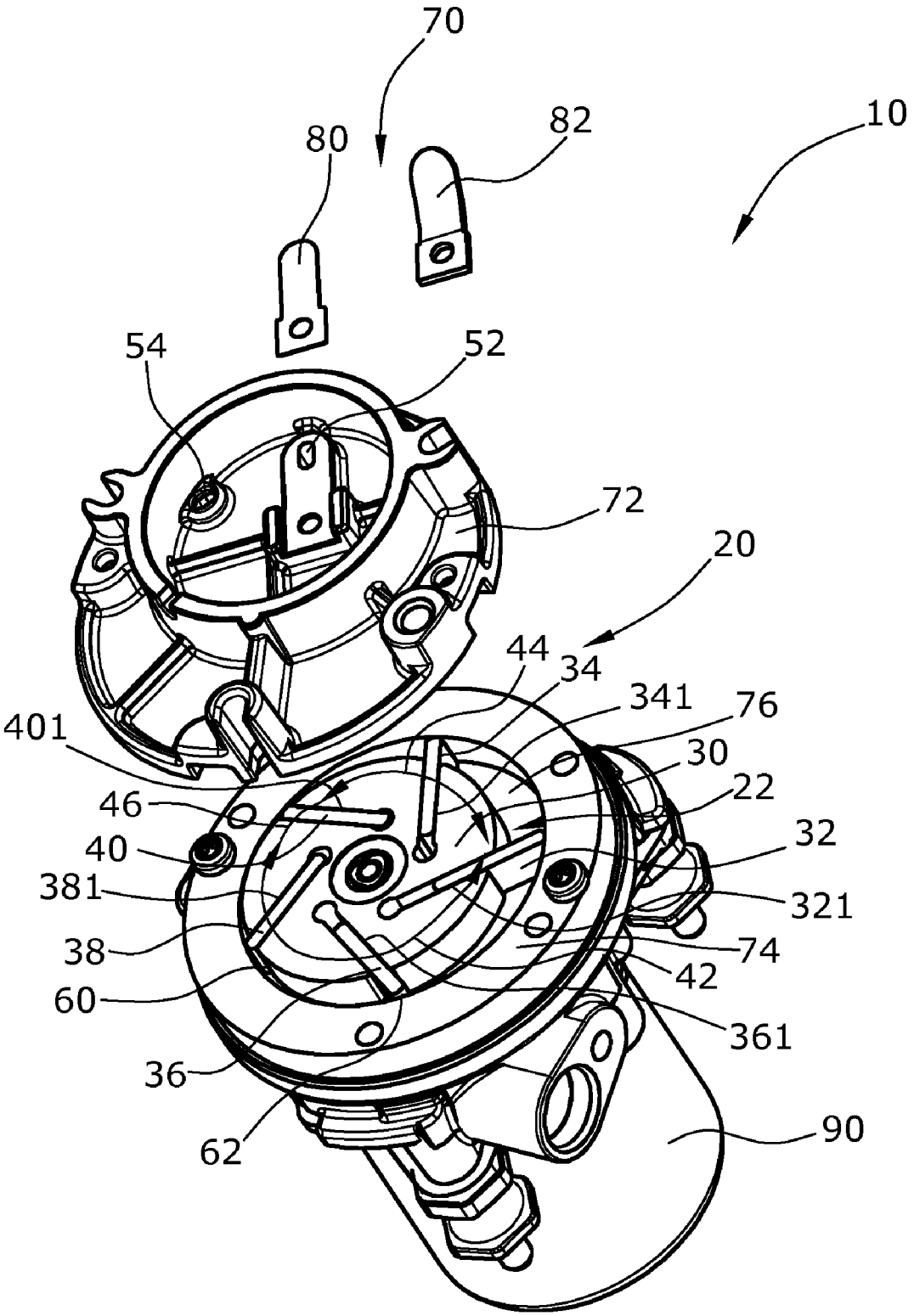
FIG. 1 shows an exploded view of a dry-running vane gas pump.
Figure 2:
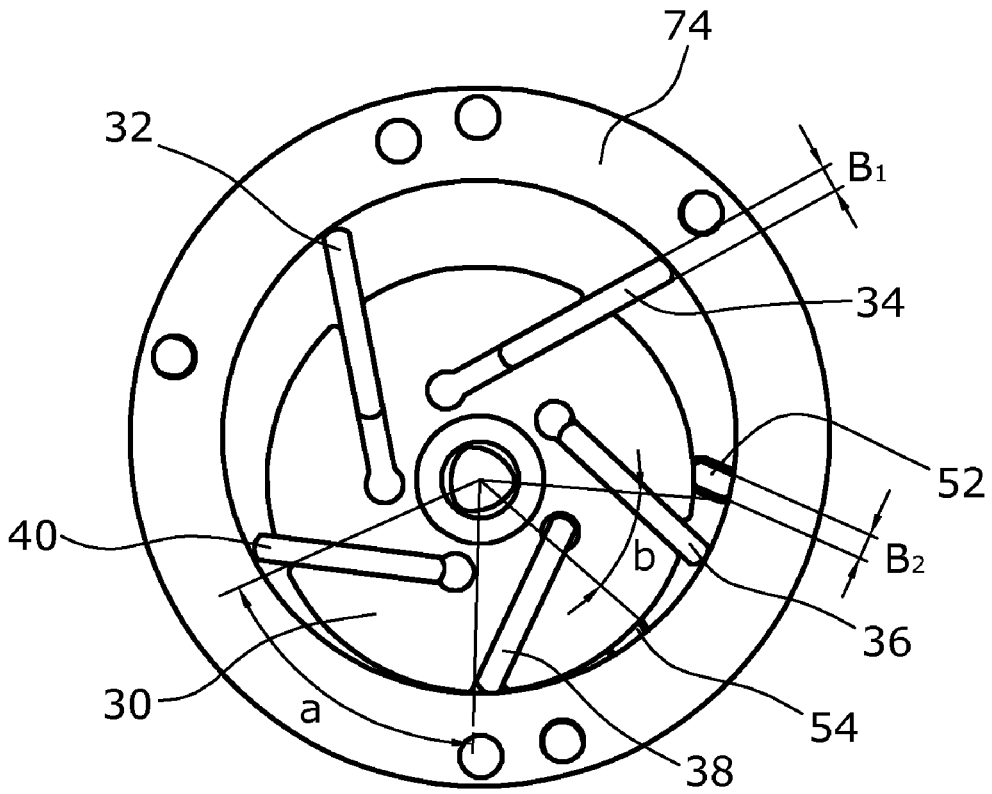
FIG. 2 shows a schematic frontal view of a dry-running vane gas pump according to FIG. 1.

The dry-running gas pump comprises a pump housing delimiting a pump chamber. A pump rotor is arranged in the pump chamber, a pump rotor being driven either electrically by an electric motor or mechanically by a combustion engine. The pump rotor is arranged eccentrically in the pump chamber and, in a sealing sector, is disposed in abutment on the circumferential wall of the pump chamber so that a sickle-shaped working chamber is created.

At least one displaceable slide element is arranged in the pump rotor. For support of the at least one slide element, the pump rotor comprises a slider slot having the at least one slide element arranged therein for a sliding displacement. In a rotating pump rotor, the at least one slide element will be displaced, under the effect of the centrifugal force acting on the slide element, in a manner causing the head of the slide element to always be in abutment on the circumferential wall of the pump chamber. The at least one slide element can also be spring-biased so that, under the effect of the spring force, the head of the at least one slide element will also be in abutment on the circumferential wall of the pump chamber at low rotational speeds.

Under the functional aspect, the pump chamber is divided into an inlet sector, an outlet sector, and a sealing sector. A fluid inlet opening is arranged in the inlet sector which is, for example, fluidically connected to a vacuum chamber of a brake force booster. A first fluid outlet opening and a second fluid outlet opening are arranged in the outlet sector, wherein, via the fluid outlet openings, the pump chamber is connectible to the ambience. The sealing sector is arranged between the fluid outlet openings and the fluid inlet opening, as viewed in the direction of rotation, the sealing sector preventing a gas flow between the fluid inlet opening and the fluid outlet openings.

The first fluid outlet opening is arranged, as viewed in the direction of rotation of the pump rotor, before the second fluid outlet opening, wherein a non-return valve is associated to the first fluid outlet opening. The non-return valve is operative to close the first fluid outlet opening and to clear the opening when a predefined overpressure prevailing in the pumping compartment is exceeded. The second fluid outlet opening does not comprise a non-return valve so that the second fluid outlet opening is permanently open.

In operation, air is sucked via the fluid inlet opening into the passing pumping compartment and is discharged from the pumping compartment via the first and the second fluid outlet opening. The air is discharged through the first fluid outlet opening as long as a pressure prevailing in the pumping compartment is higher than the pressure required for operation of the non-return valve. The air is also discharged through the second fluid outlet opening, wherein the second fluid outlet opening does not have non-return valve associated to it, thus allowing the air to flow out from the pumping compartment without being impeded. Overpressure in this region is avoided because of the absence of a non-return valve associated to the second fluid outlet opening and the unimpeded discharge of the air from the pumping compartment. The mechanical stress on the at least one slide element is thereby lowered and the wear of the at least one slide element is reduced.

In an embodiment of the present invention, at least two slide elements can, for example, be supported in the pump rotor, whereby the hydraulic efficiency of the vane gas pump is enhanced since, with increasing number of slide elements, leakage between the pressure side and the suction side is considerably reduced.

In an embodiment of the present invention, the angular distance between the first fluid outlet opening and the second fluid outlet opening can, for example, be smaller than the pumping compartment angle. The angular distance is defined as the angular distance between the trailing edge of the first fluid outlet opening and the leading edge of the second fluid outlet opening. The pumping compartment angle is defined by two adjacent slide elements. Since the angular distance between the first and the second fluid outlet opening is smaller than the pumping compartment angle, the pumping compartment in the outlet sector is at all times fluidically connected to at least one fluid outlet opening. A pressure build-up in the pumping compartment is thereby avoided, as would be caused if the pumping compartment in the outlet sector would temporarily be connected to none of the two fluid outlet openings and the to-be-discharged air would not be allowed to flow out. The mechanical tangential stress on the slide element is thereby reduced.

In an embodiment of the present invention, the tangential width B1 of the at least one slide element can, for example, correspond at least to the tangential width B2 of the first fluid outlet opening, whereby the second fluid outlet opening, when traveled over by the at least one slide element, will be completely covered and briefly closed. A short circuit between the pumping compartments delimited by the at least one slide element is thereby prevented and the pneumatic efficiency of the gas pump is increased.

In an embodiment of the present invention, at least the head of the at least one slide element can, for example, be made of graphite. Dry lubrication is thereby realized, wherein the slide element head made of graphite will, with advancing operational life, undergo a controlled wear. Graphite is relatively soft. Particularly in case of a slide element head made of graphite, the present invention provides for a considerable reduction of the mechanical wear of the head.

In an embodiment of the present invention, the pump housing can, for example, comprise a valve cover, a stroke ring, and a bottom cover. The stroke ring forms the circumferential surface of the pump chamber and has an end side arranged in abutment on the valve cover and has its other end side arranged in abutment on the bottom cover. The valve cover seals off the pump chamber on one side and comprises the at least two fluid outlet openings. The bottom element can, for example, comprise the fluid inlet opening.

In an embodiment of the present invention, the non-return valve can, for example, be a reed valve with a path delimiter. A valve of this type can be produced at low expense and can be mounted in a reliable and simple manner.

The present invention will be explained in greater detail below under reference to the drawings.

FIG. 1 shows a vane gas pump 10 designed as a so-called vacuum pump, which is provided particularly for use in a motor vehicle and which is adapted to generate an absolute pressure of, for example, 100 mbar or less. The vane gas pump 10 comprises a metallic pump housing 20 defining a pump chamber 22. The pump housing 20 is substantially composed of a stroke ring 74, a bottom plate 76 and a valve cover 72.

A pump rotor 30 is rotationally arranged within the pump chamber 22 eccentrically to the center of gravity of pump chamber 22. Pump rotor 30 comprises five slider slots 321, 341, 361, 381, 401 in which a respective slide element 32, 34, 36, 38, 40 is displaceably arranged. The five respective slide elements 32, 34, 36, 38, 40 divide the pump chamber 22 into five rotating pumping compartments, each of which comprise the same pumping compartment angle a. A head 62 of the slide elements 32, 34, 36, 38, 40 can, for example, be made of graphite. In the present embodiment, pump rotor 30 is driven by an electric motor 90.

The pump chamber 22 can be divided into several sectors, namely an inlet sector 42 having a fluid inlet opening 60, an outlet sector 44 having a first fluid outlet opening 52 and a second first fluid outlet opening 54, and a sealing sector 46 which, when viewed in the direction of rotation, is arranged between outlet sector 44 and inlet sector 42 and is effective to prevent a gas flow from the fluid outlet openings 52, 54 to the fluid inlet opening 60.

The fluid inlet opening 60 is formed in the bottom plate 76. The first fluid outlet opening 52 and the second fluid outlet opening 54 are each formed in the valve cover 72. The first fluid outlet opening 52 is arranged, when viewed in the direction of rotation of pump rotor 30, before the second fluid outlet opening 54. The first fluid outlet opening 52 has a non-stop valve 70 fluidically associated thereto, wherein the non-stop valve 70 is a reed valve and comprises a valve tongue 80 and a path delimiter 82, both of which are fixedly arranged on the valve cover 72. The second fluid outlet opening 54 has no valve associated thereto, so that the second fluid outlet opening 54 is permanently open and will allow for an unimpeded fluid flow.

The second fluid outlet opening 54 is spaced from the first fluid outlet opening 52 by an angular distance b, wherein the angular distance b is measured between the leading edge of the second fluid outlet opening 54 and the trailing edge of the first fluid outlet opening 52. The angular distance b is smaller than the pumping compartment angle a enclosed by two adjacent slide elements 32, 34, 36, 38, 40 so that a pumping compartment passing through the outlet sector 44 will always be in fluidic connection with at least one of the first fluid outlet opening 52 and the second fluid outlet opening 54.

During operation of the vane gas pump 10, air will be sucked in through the fluid inlet opening 60 due to the rotation of pump rotor 30 and will be discharged from the pumping compartment through the first fluid outlet opening 52 and the second fluid outlet opening 54. As long as a predefined overpressure prevails in the pumping compartment, the first fluid outlet opening 52 is cleared, and the air will be discharged through the second fluid outlet opening 54. The air will also be discharged through the second fluid outlet opening 54. Since the second fluid outlet opening 54 has no valve associated thereto, the air will be discharged in an unimpeded manner, without a pressure build-up being caused due to the non-return valve. The tangential stress on the slide elements 32, 34, 36, 38, 40 is thereby lowered and the wear of the slide elements 32, 34, 36, 38, 40 is reduced. The power consumption of the electric motor 90 and the obtainable end pressure are also reduced.

It should be evident that other constructional embodiments of the dry-running vane gas pump are also possible as compared to the above described embodiment without departing from the scope of protection of the present invention. The number of slide elements can, for example, be varied, or the fluid inlet opening and/or the fluid outlet openings can be formed on other housing components. Reference should also be had to the appended claims.

What is claimed is:

1. A dry-running vane gas pump comprising:

a pump housing configured to form a pump chamber;

a pump rotor comprising at least one displaceable slide element, the pump rotor being rotatably supported in the pump chamber;

at least one fluid inlet opening associated with the pump chamber;

a first fluid outlet opening associated with the pump chamber;

a second fluid outlet opening associated with the pump chamber, the second fluid outlet opening being configured to be permanently open so that air flows out of the pump chamber via the second fluid outlet opening to atmosphere without being impeded; and a non-return valve configured to close the first fluid outlet opening, wherein, the first fluid outlet opening is arranged before the second fluid outlet opening in a direction of rotation of the pump rotor.

2. The dry-running vane gas pump as recited in claim 1, wherein, the pump rotor comprises at least two of the at least one displaceable slide element, and the at least two of the at least one displaceable slide element are supported in the pump rotor.

3. The dry-running vane gas pump as recited in claim 2, wherein, a fluid opening angle exists between the first fluid outlet opening and the second fluid outlet opening as measured from a center of the pump rotor, a pumping compartment angle exists between adjacent displaceable slide elements of the at least two of the at least one displaceable slide element as measured from the center of the pump rotor, and the fluid opening angle is smaller than the pumping compartment angle.

4. The dry-running vane gas pump as recited in claim 1, wherein, the at least one displaceable slide element comprises a head, and at least the head of the at least one displaceable slide element is made of graphite.

5. The dry-running vane gas pump as recited in claim 1, wherein, the pump housing comprises a valve cover, a stroke ring and a bottom cover, the valve cover, the stroke ring and the bottom cover together define the pump chamber, and the valve cover is configured to comprise the first fluid outlet opening and the second fluid outlet opening.

6. The dry-running vane gas pump as recited in claim 5, wherein the bottom cover comprises the fluid inlet opening.

7. The dry-running vane gas pump as recited in claim 1, wherein the non-return valve is a reed valve which comprises a path delimiter.

* * * * *